US006268801B1

(12) United States Patent
Wu

(10) Patent No.: US 6,268,801 B1
(45) Date of Patent: Jul. 31, 2001

(54) METHOD AND APPARATUS FOR RETRO-FITTING A TRAFFIC SIGNAL LIGHT WITH A LIGHT EMITTING DIODE LAMP MODULE

(75) Inventor: Chen H. Wu, Los Altos Hills, CA (US)

(73) Assignee: Leotek Electronics Corporation, Taipei Hsien (TW)

( * ) Notice: Subject to any disclaimer, the term of this patent is extended or adjusted under 35 U.S.C. 154(b) by 0 days.

(21) Appl. No.: 09/325,623

(22) Filed: Jun. 3, 1999

(51) Int. Cl.[7] ..... G08B 5/22; G09F 9/33

(52) U.S. Cl. ..... 340/815.45; 340/912; 40/550

(58) Field of Search ..... 340/815.45, 907, 340/912, 641, 642, 815.76, 815.67; 116/63 R; 362/800; 40/544, 550

(56) References Cited

U.S. PATENT DOCUMENTS

| | | | | |
|---|---|---|---|---|
| 3,800,137 | * | 3/1974 | Fredell | 340/912 |
| 4,298,869 | | 11/1981 | Okuno . | |
| 4,682,147 | | 7/1987 | Bowman . | |
| 4,887,074 | | 12/1989 | Simon et al. . | |
| 5,040,320 | | 8/1991 | Reidinger . | |
| 5,136,287 | * | 8/1992 | Borenstein | 340/925 |
| 5,388,357 | | 2/1995 | Malita . | |
| 5,410,453 | | 4/1995 | Ruskouski . | |

(List continued on next page.)

OTHER PUBLICATIONS

Quantum Lamps, Ameratech R&D Inc. & Leotek Inc. product information sheet, 2 pages, Pub. Feb. 1992.

Maintnance–Free L.E.D. Exit Sign, Leotek Electronics Corporation product information sheet, 2 pages, Pub. 1995.

Leotek Lamps, Leotek Electronics Corporation product information sheet, 2 pages, Pub. Aug., 1996.

Leotek Open Signs, Leotek Electronics Corporation product information sheet, 2 pages, Pub. 1996.

Astralite 2000, Astralite product information sheet, 2 pages, Pub. 1994.

T6.5 Ultra Lite, Halco Lighting Corporation product information sheet, 1 page, Pub. 1995.

Redhead LED Exit Lamp, TCP product information sheet, 1 page, Pub. 1995.

E–Z Lamp, Isolite Corp. product information sheet, 2 pages, Pub. 1995.

Exbrite Exit Retrofit, Conservalite Technologies, Inc. product information sheet, 1 page, Pub. Apr. 1996.

Bright Idea, Standard Enterprises, Inc., product information sheet, 2 pages, Pub. Mar. 1996.

Universal T Lamp, Area Lighting Research, Inc. product information sheet, 2 pages, Pub. Apr. 1996.

Wattman LED Exit Retrofit Lamp, Standard Enterprises Inc., product information sheet, 2 pages, Pub. 1995.

*Primary Examiner*—Jeffery Hofsass
*Assistant Examiner*—John Tweel, Jr.
(74) *Attorney, Agent, or Firm*—Gray Cary Ware & Freidenrich LLP

(57) ABSTRACT

A method and apparatus for retro-fitting a traffic signal lamp with an LED lamp module. The traffic signal lamp has a housing, a front door plate attached to the housing, a lens attached to the front door plate, a reflector in the housing, a threaded electrical socket connector in the housing, and a threaded light bulb connected into the socket connector. The LED lamp including a plurality of light emitting diodes, a power supply electrically connected to the plurality of light emitting diodes, and wires extending from the power supply that terminate in a threaded electrical connector compatible with the socket connector. The method of the present invention includes removing the lens from the front door plate, removing the threaded light bulb from the socket connector, affixing an LED lamp module to the front door plate, and connecting the threaded electrical connector of the LED lamp module to the socket connector.

9 Claims, 4 Drawing Sheets

U.S. PATENT DOCUMENTS

| | | | | |
|---|---|---|---|---|
| 5,416,679 | | 5/1995 | Ruskouski et al. . | |
| 5,428,912 | | 7/1995 | Grondal et al. . | |
| 5,459,955 | | 10/1995 | Ruskouski et al. . | |
| 5,463,280 | | 10/1995 | Johnson . | |
| 5,526,236 | | 6/1996 | Burnes et al. . | |
| 5,561,346 | | 10/1996 | Byrne . | |
| 5,655,830 | | 8/1997 | Ruskouski . | |
| 5,663,719 | * | 9/1997 | Deese et al. | 340/912 |
| 5,688,042 | | 11/1997 | Madadi et al. . | |
| 5,726,535 | | 3/1998 | Yan . | |
| 5,729,925 | | 3/1998 | Prothero . | |
| 5,890,794 | | 4/1999 | Abtahi et al. . | |
| 5,949,347 | * | 9/1999 | Wu | 340/815.45 |
| 6,036,336 | * | 3/2000 | Wu | 40/550 |

* cited by examiner

METHOD AND APPARATUS FOR RETRO-FITTING A TRAFFIC SIGNAL LIGHT WITH A LIGHT EMITTING DIODE LAMP MODULE

FIELD OF THE INVENTION

The present invention relates to Light-Emitting Diode (LED) lamps for traffic signal lights, and more particularly to an improved retrofit method for replacing conventional light bulbs in traffic signal lights with LED lamps, including 12 and 8 inch round traffic signal lamps, pedestrian signs, hand signs, arrow signs and signs with messages.

BACKGROUND OF THE INVENTION

Light emitting diode (LED) lamps have been developed to replace conventional incandescent or fluorescent lamps for reducing electrical and maintenance costs, and for increasing reliability. LED lamps consume less electrical energy than conventional lamps while exhibiting much longer lifetimes. Such LED lamps typically include a power supply and a plurality of LEDs mounted on a flat or curved surface.

One growing use of LED lamps is the replacement of incandescent light bulbs in traffic signal lamps. A common conventional traffic signal lamp is illustrated in FIGS. 1 and 2, and includes a housing 1, a front door plate 2, a lens 3, a reflector 4 and an incandescent light bulb 5. Retainers 6 affix the lens 3 to the front door plate 2, which opens via hinges 7 to allow access to the interior of the housing 1. Light bulb 5 screws into electrical socket 8, which is electrically attached to a terminal strip 9, which in turn receives its power from the traffic signal controller.

It is known to replace the incandescent light bulb 5 with an LED lamp, along with the lens 3 since it is designed for the output of an incandescent light bulb. In a conventional traffic signal lamp retrofit procedure, the lens 3, light bulb 5, reflector 4 and socket 8 are all removed, and an LED lamp module 10 is installed to the front door plate 2 to replace lens 3, as illustrated in FIG. 2. Wires 11 from the LED lamp module are connected to the terminal strip 9.

The above mentioned retrofit method has several drawbacks. First, it is time consuming and labor intensive to remove the reflector 4 and socket 8, and access the terminal strip 9 with new wiring. Because traffic is usually blocked in order to access traffic lights, time is of the essence. Second, in order to safely disconnect the socket connector wires from the terminal strip, and connect new wires from the LED lamp module 10 to the terminal strip, the power to the traffic signal must be temporarily turned off, which disrupts traffic flow through the intersection. Finally, once the retrofit is complete, it is not possible to put the original incandescent lamp back in the traffic signal lamp, for example in case a spare LED lamp is not available.

There is a need for an LED lamp and retrofit procedure for traffic signal lamps that is fast, simple, requires minimal labor to install, does not require turning the power off to the traffic signal, and allows reinstallation of the original incandescent lamp.

SUMMARY OF THE INVENTION

The present invention solves the aforementioned problems by providing a method of replacing a conventional traffic signal lamp with an LED lamp that is quick, simple, uses minimal labor, and can be safely performed with the power to the traffic signal left on. The existing incandescent lamp socket is left intact, so that the original lamp can be reinstalled back into the traffic signal lamp should the need arise.

The present invention is a method of retrofitting a traffic signal lamp with an LED lamp, where the traffic signal lamp includes a housing, a front door plate attached to the housing, a lens attached to the front door plate, a reflector in the housing, a threaded electrical socket connector in the housing, and a threaded light bulb connected into the socket connector. The method includes the steps of removing the lens from the front door plate, removing the threaded light bulb from the threaded socket connector, and affixing an LED lamp module to the front door plate. The LED lamp module includes a plurality of light emitting diodes, a power supply electrically connected to the plurality of light emitting diodes, wires extending from the power supply that terminate in a threaded electrical connector compatible with the socket connector. The method further includes connecting the threaded electrical connector of the LED lamp module to the threaded socket connector.

In another aspect of the present invention, an LED lamp module includes a housing, a plurality of light emitting diodes, a power supply disposed in the housing and electrically connected to the plurality of light emitting diodes, and wires connected to the power supply. The wires extend from the housing and terminate in a threaded electrical connector.

Other objects and features of the present invention will become apparent by a review of the specification, claims and appended figures.

DETAILED DESCRIPTION OF THE PREFERRED EMBODIMENTS

The present invention is an LED lamp and method of installation thereof for conventional traffic signal lamps.

Figure 3:
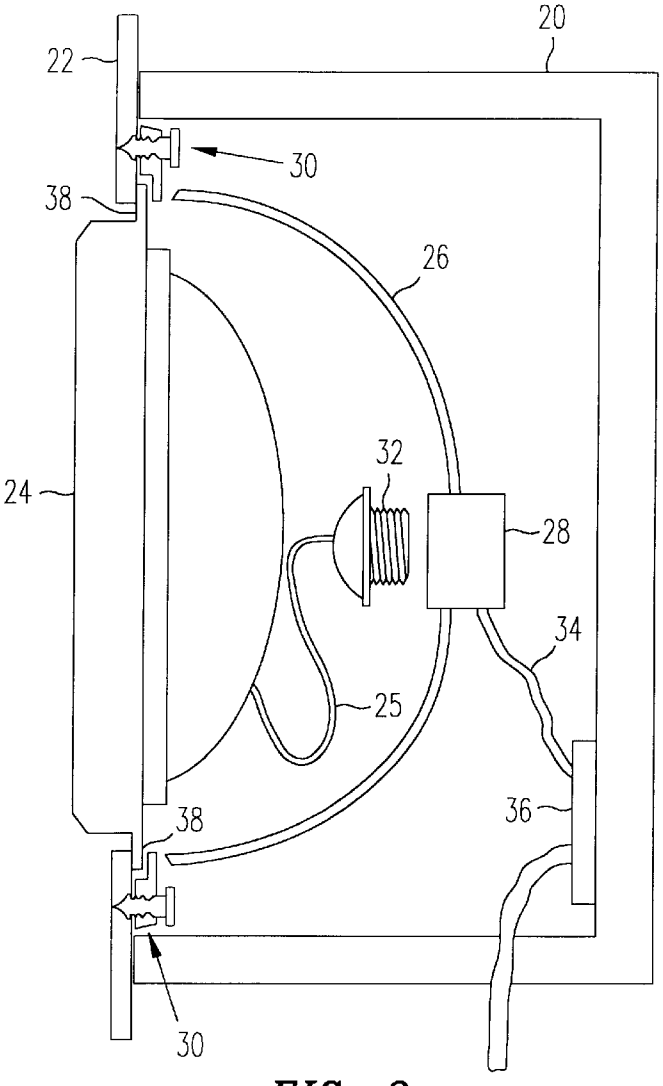
FIG. 3 is a side cross-sectional view of a traffic signal lamp retro-fitted with an LED lamp module according to the present invention.

A retro-fitted traffic signal lamp according to the present invention is illustrated in FIG. 3, and includes a housing 20, a front door plate 22, an LED lamp module 24, a reflector 26 and a threaded socket connector 28. Retainers 30 affix the LED lamp module 24 to the front door plate 22, which opens via hinges to allow access to the interior of the housing 20. LED lamp module 24 includes a plurality of light emitting diodes connected to a power supply, from which wires 25 extend. Wires 25 terminate in a threaded electrical connector 32 that screws into socket connector 28. Wires 34 connect socket connector 28 to a terminal strip 36, which receives its power from the traffic signal controller.

Figure 2:
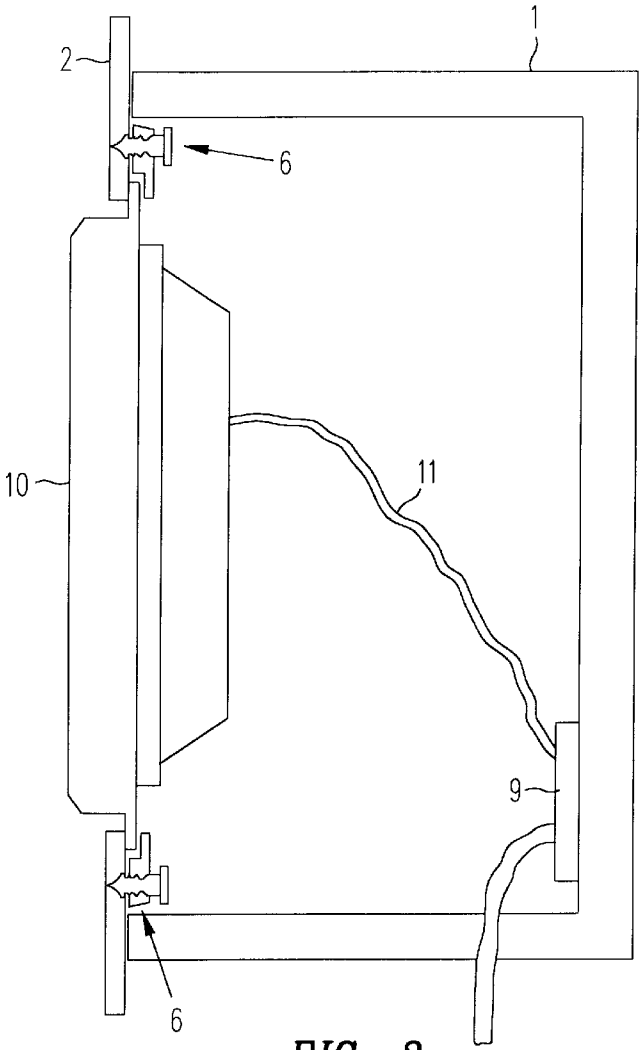
FIG. 2 (Prior Art)
FIG. 2 is a side cross-sectional view of a conventional traffic signal lamp containing a conventional LED lamp module.
Figure 1A:
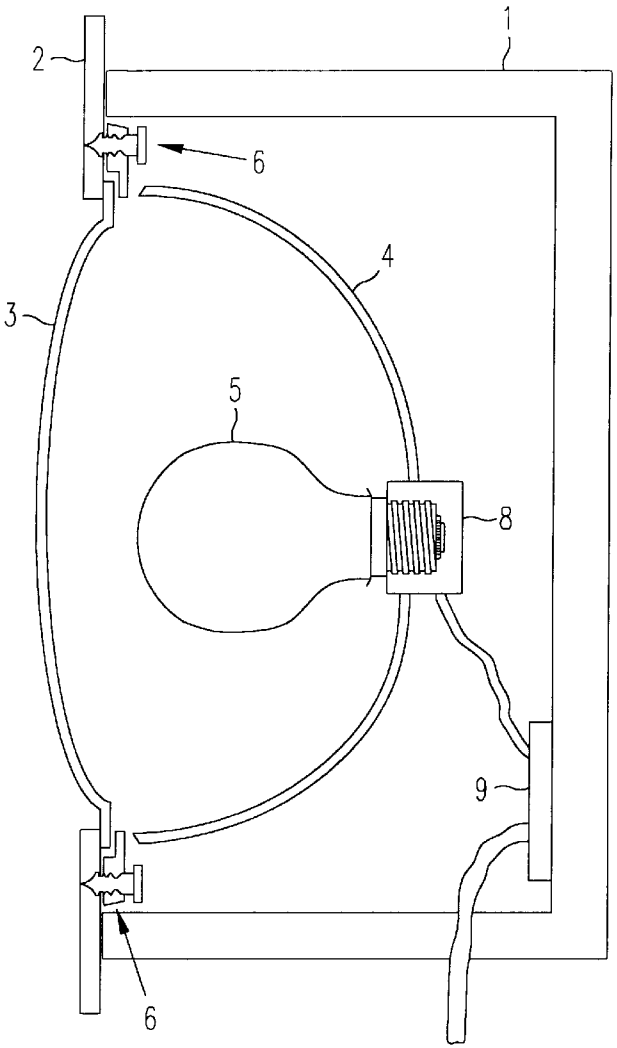
FIG. 1A (Prior Art)
FIG. 1A is a side cross-sectional view of a conventional traffic signal lamp.
Figure 1B:
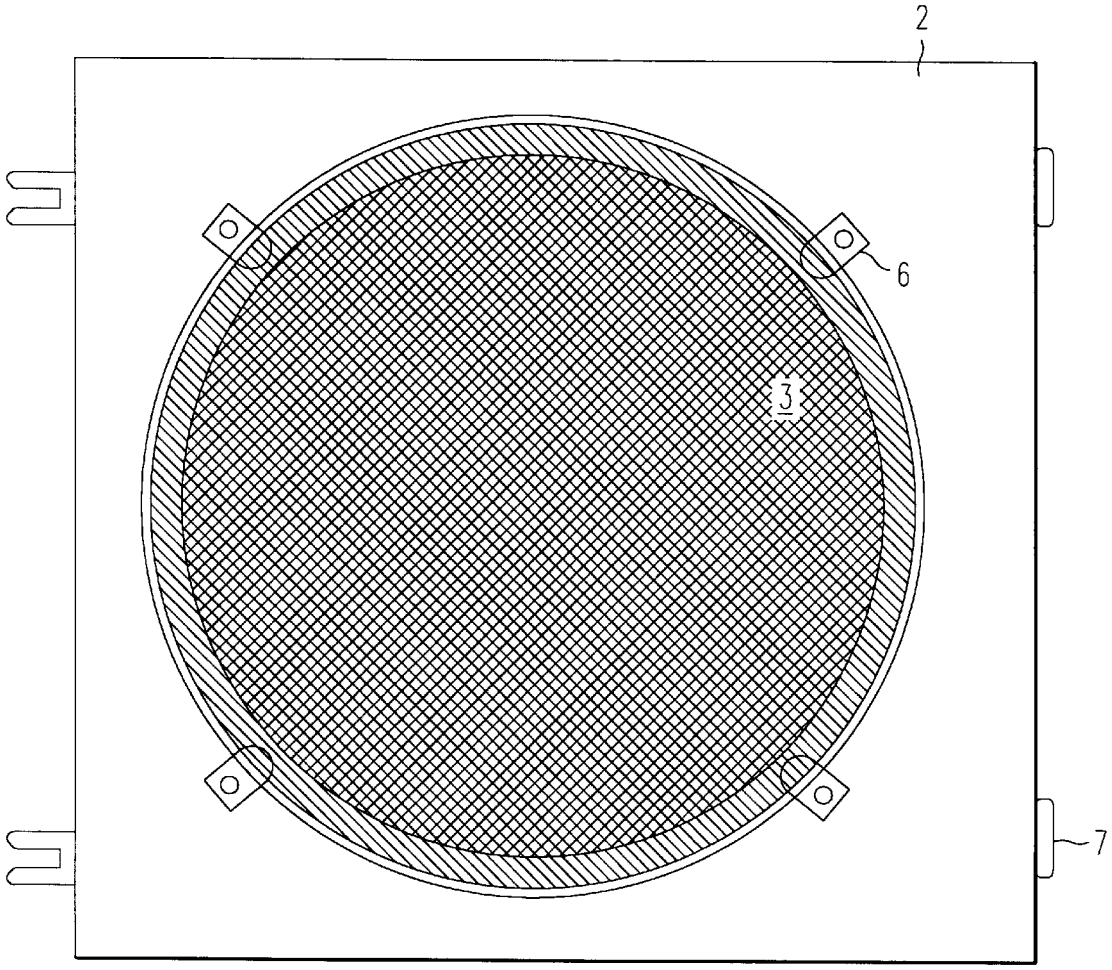
FIG. 1B (Prior Art)
FIG. 1B is a back view of a front door from a conventional traffic signal lamp.

In order to retrofit the conventional traffic signal lamp of FIGS. 1A and 1B with the LED lamp module 24 as shown in FIG. 3, the front door plate 22 is rotated open to expose the inside of housing 20. Retainers 30 are loosened, and lens 3 is removed. Lamp module 24, which has the same outer circumference and shape as the lens 3, is affixed to the front door plate by the retainers 30. The incandescent light bulb 5 is unscrewed out of the existing socket connector 28, and threaded electrical connector 32 is screwed into socket connector 28. Then, the front door plate 22 is closed.

This retrofit procedure is simple, takes very little time and labor, and can be safely performed without turning power off to the traffic signal lamp. Typical traffic signal lamps have lenses that are 8 or 12 inches in diameter. As long as the outer rim of LED lamp module 24 has a similar shape and diameter as the outer rim of lens 3, then the same retainers 30 that secured the lens 3 in place on the front door plate 22 can be used to secure the LED lamp module 24 in place. In the preferred embodiment, LED lamp module 24 has a flange 38 that is shaped and sized to match the outer rim of lens 3 that it replaces.

Figure 4:
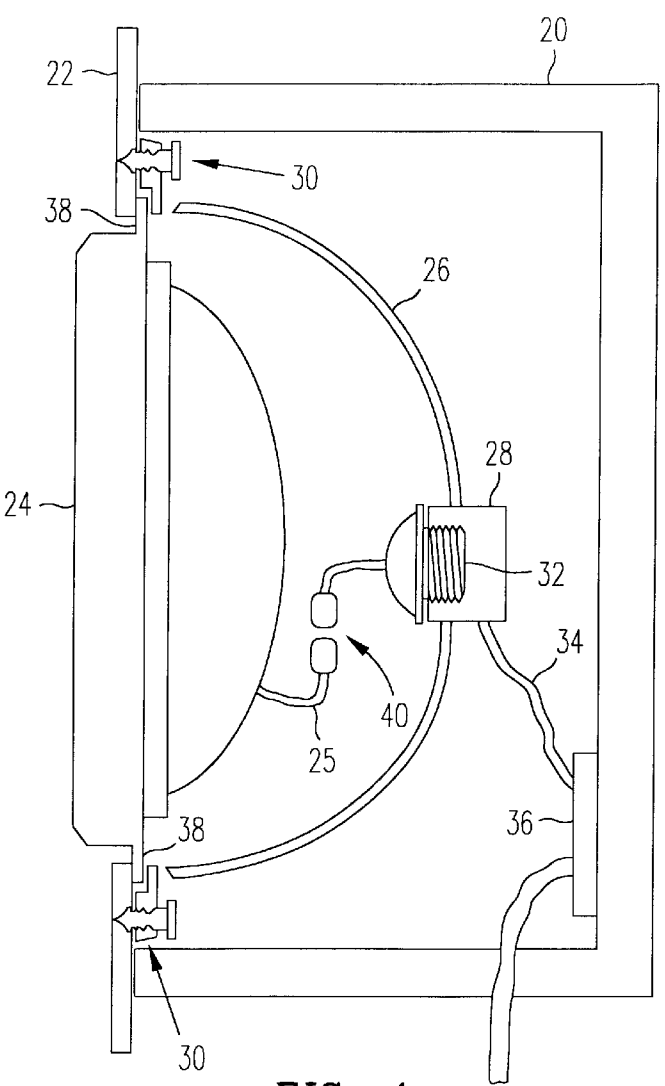
FIG. 4 is a side cross-sectional view of a traffic signal lamp retro-fitted with an LED lamp module according to a first alternate embodiment of the present invention.
Figure 5:
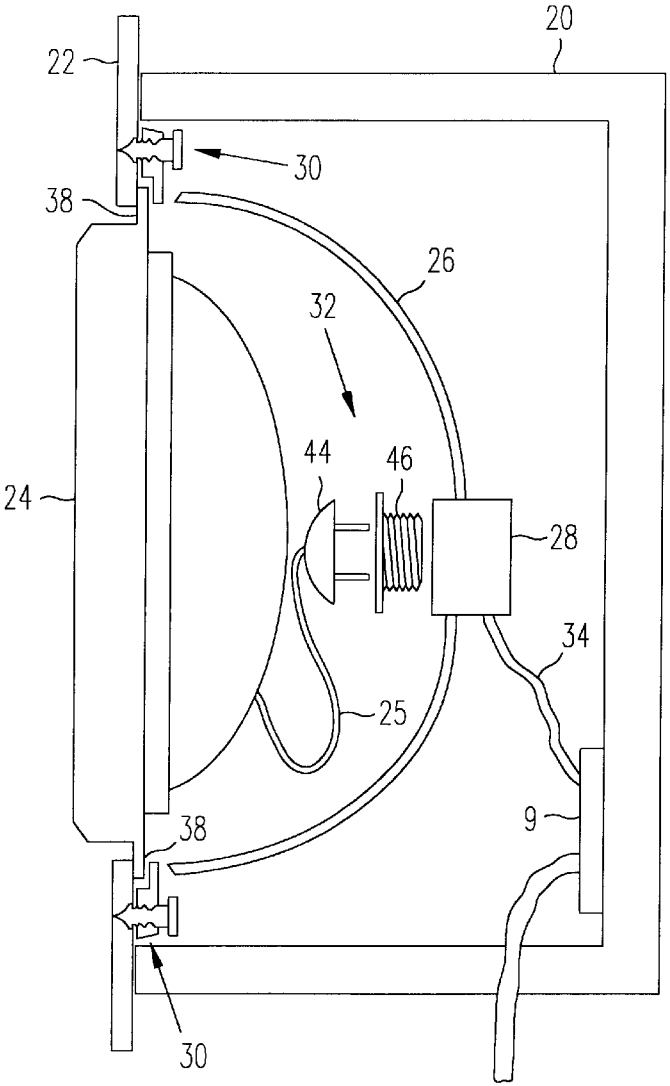
FIG. 5 is a side cross-sectional view of a traffic signal lamp retrofitted with an LED lamp module according to a second alternate embodiment of the present invention.
Figure 6:
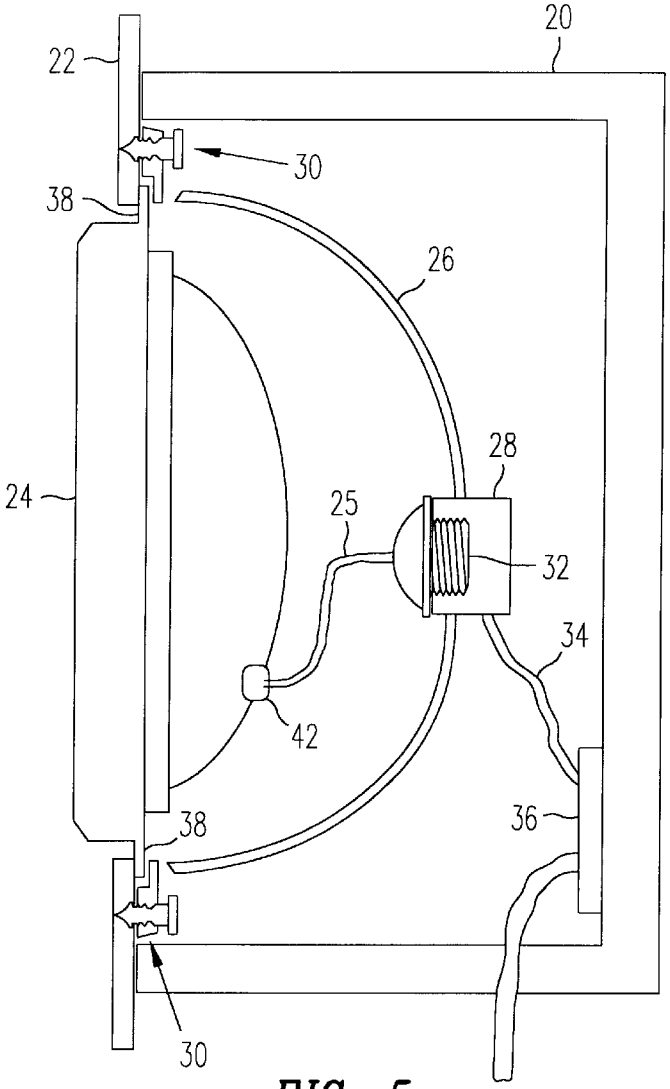
FIG. 6 is a side cross-sectional view of a traffic signal lamp retrofitted with an LED lamp module according to a third alternate embodiment of the present invention.

FIGS. 4–6 show alternate embodiments of the LED lamp modules 24 of the present invention. FIG. 4 illustrates a removable electrical connector 40 on wires 25 to facilitate screwing in threaded connector 32 into socket connector 28. FIG. 5 illustrates a removable connector 42 that removably connects wires 25 to LED lamp module 24. FIG. 6 illustrates that the threaded connector 32 comprises a pronged plug 44 and a threaded adapter 46. The threaded adapter 46 screws into the socket connector 28, and the pronged plug 44 plugs into the adapter 46.

It is to be understood that the present invention is not limited to the embodiments described above and illustrated herein, but encompasses any and all variations falling within the scope of the appended claims. For example, part or all of reflector 26 could be removed during the retrofitting process, so long as the socket electrical connector stays intact. Further, the method of the present invention applies to any lamp that utilizes a conventional threaded light bulb with a lens mounted thereover.

What is claimed is:

1. The method of retro-fitting a traffic signal lamp with an LED lamp, where the traffic signal lamp has a housing, a front door plate attached to the housing, a lens attached to the front door plate, a reflector in the housing, a threaded electrical socket connector in the housing, and a threaded light bulb connected into the socket connector, the method comprising the steps of:

removing the lens from the front door plate;

removing the threaded light bulb from the threaded socket connector;

affixing an LED lamp module to the front door plate, wherein the LED lamp module includes:

a plurality of light emitting diodes, a power supply electrically connected to the plurality of light emitting diodes, wires extending from the power supply that terminate in a threaded electrical connector compatible with the socket connector; and connecting the threaded electrical connector of the LED lamp module to the threaded socket connector.

2. The method of claim 1, wherein the front door plate includes a lens retainer to secure the lens in place, and wherein the LED lamp module is shaped to engage with, and be secured in place by, the retainer.

3. The method of claim 2, wherein the LED lamp module has a flange on an outer rim thereof for engagement with the retainer.

4. The method of claim 3, wherein the flange has a diameter that is substantially 8 inches or 12 inches.

5. The method of claim 1, wherein the threaded electrical connector of the LED lamp module comprises:

a plug with prongs, and a threaded socket adapter having threads at one end and receptacles for plug prongs in another end;

wherein the connecting step includes the steps of:

screwing the socket adapter into the socket connector, and plugging the plug prongs into the receptacles of the socket adapter.

6. The method of claim 1, wherein the wires extending from the LED lamp module further include a removable electrical connector at a point along a length thereof.

7. The method of claim 1, wherein the wires extending from the LED lamp module are removably connected to the LED lamp module by a removable electrical connector.

8. The method of claim 2, wherein the plurality of light emitting diodes are arranged in the shape of an arrow.

9. The method of claim 2, wherein the plurality of light emitting diodes are arranged in the shape of a hand or a pedestrian.

* * * * *